US011019895B2

(12) United States Patent
Zhu

(10) Patent No.: US 11,019,895 B2
(45) Date of Patent: Jun. 1, 2021

(54) LUGGAGE CASE AND CASE BODY STRUCTURE THEREOF

(71) Applicant: Jiaxing Jackson Travel Products Co., Ltd., Zhejiang (CN)

(72) Inventor: Xue Lin Zhu, Jiaxing (CN)

(73) Assignee: Jiaxing Jackson Travel Products Co., Ltd., Zhejiang (CN)

( * ) Notice: Subject to any disclaimer, the term of this patent is extended or adjusted under 35 U.S.C. 154(b) by 81 days.

(21) Appl. No.: 16/377,584

(22) Filed: Apr. 8, 2019

(65) Prior Publication Data

US 2019/0231044 A1 Aug. 1, 2019

Related U.S. Application Data

(63) Continuation-in-part of application No. 15/210,043, filed on Jul. 14, 2016, now abandoned.

(30) Foreign Application Priority Data

Apr. 19, 2016 (CN) ..... 201620330912.X
Apr. 19, 2016 (CN) ..... 201620334755.X

(51) Int. Cl.
*A45C 5/03* (2006.01)
*A45C 5/14* (2006.01)
*A45C 13/04* (2006.01)

(52) U.S. Cl.
CPC ..... *A45C 5/03* (2013.01); *A45C 5/14* (2013.01); *A45C 13/04* (2013.01); *A45C 2005/035* (2013.01); *A45C 2005/037* (2013.01)

(58) Field of Classification Search
CPC .. A45C 5/03; A45C 5/14; A45C 13/04; A45C 2005/035; A45C 2005/037
See application file for complete search history.

(56) References Cited

U.S. PATENT DOCUMENTS 1,902,313 A 3/1933 Struble
3,084,771 A 4/1963 Davis
3,330,388 A 7/1967 Stein
(Continued)

FOREIGN PATENT DOCUMENTS

CN 202456880 10/2012
EP 2873342 A1 5/2015
(Continued)

*Primary Examiner* — Tri M Mai
(74) *Attorney, Agent, or Firm* — Muncy, Geissler, Olds & Lowe, P.C.

(57) ABSTRACT

A case body structure of a luggage case includes a case top member, a case bottom member and a sidewall member that are independent components. Each of the case top member and the case bottom member is a hard structure. The sidewall member includes a wall plate and a cover plate. The wall plate includes a connecting section, two installation sections, and an installation breach defined and formed by the two installation sections. The cover plate is disposed correspondingly to the installation breach. The cover plate and the wall plate define a hollow cavity. The case top member and the case bottom member are respectively disposed at two ends of the sidewall member to enclose the hollow cavity. The cover plate selectively opens relative to the wall plate to allow an object to be placed into or taken out of the hollow cavity.

13 Claims, 10 Drawing Sheets

(56) References Cited

U.S. PATENT DOCUMENTS

| | | | | |
|---|---|---|---|---|
| 3,881,580 | A | 5/1975 | Doppelt | |
| 5,566,797 | A | 10/1996 | Van Himbeeck | |
| 5,713,439 | A | 2/1998 | Zionts et al. | |
| 5,782,325 | A * | 7/1998 | O'Shea | A45C 5/14 16/113.1 |
| 6,220,412 | B1 | 4/2001 | Lin | |
| 6,220,413 | B1 | 4/2001 | Lin | |
| 6,834,920 | B2 | 12/2004 | Landsberger et al. | |
| 7,392,888 | B2 * | 7/2008 | Lai | A45C 13/04 190/115 |
| 8,690,169 | B2 * | 4/2014 | Lu | B60B 33/0002 280/79.2 |
| 9,480,316 | B2 | 11/2016 | Kogelnik | |
| 9,675,154 | B2 * | 6/2017 | Tong | A45C 13/36 |
| 10,131,185 | B1 * | 11/2018 | Frankel | B60B 33/0039 |
| 10,791,809 | B2 * | 10/2020 | Meersschaert | A45C 5/03 |
| 10,799,001 | B2 * | 10/2020 | Rankin | A45C 5/14 |
| 2002/0024189 | A1 | 2/2002 | Chen | |
| 2013/0264162 | A1 | 10/2013 | Kogelnik | |
| 2014/0151174 | A1 | 6/2014 | Briccola | |
| 2014/0224608 | A1 | 8/2014 | Tang | |
| 2016/0206069 | A1 * | 7/2016 | Tong | A45C 5/02 |

FOREIGN PATENT DOCUMENTS

| | | |
|---|---|---|
| TW | 404193 | 9/2000 |
| TW | M332408 | 5/2008 |

* cited by examiner

LUGGAGE CASE AND CASE BODY STRUCTURE THEREOF

CROSS-REFERENCE TO RELATED APPLICATION

This application is a continuation-in-part, and claims priority, from U.S. patent application Ser. No. 15/210,043 filed on Jul. 14, 2016, entitled "LUGGAGE CASE AND CASE BODY STRUCTURE THEREOF", the entire contents of which are hereby incorporated by reference.

FIELD OF THE INVENTION

The present invention relates to a luggage case and a case body structure thereof.

BACKGROUND OF THE INVENTION

To conveniently carry various objects for traveling or house moving, luggage cases are some of the first choices for loading objects. The most eye-catching part of a luggage case is the case body of the luggage case, which is much targeted by many consumers when a luggage case is chosen and purchased. Some main factors that consumers consider include the size and the outer appearance of the case body. For example, current luggage case structures are as disclosed by the Taiwan Patent Nos. 404193 and No. M332408, the China Patent No. 202456880, the U.S. Patent Publication No. 2014/0224608, and the European Patent No. 2873342A1, and have case bodies that are categorized based on the type of materials used. Current case body structures are chiefly categorized into two types—made of a textile fabric, and made of a plastic material in a formed integral.

Luggage cases made of textile fabrics eliminate costs for developing and manufacturing molds, with however large amounts of manpower and textile machinery required as a trade-off, leading to overall costs that cannot be lowered due to manpower costs and disfavored mass production. Further, for luggage cases implemented by plastic materials, although they can be mass produced once large sums of mold costs are invested at the beginning of the development and manufacturing process, the molds made are strictly limited to the use of one single product. In the event of slow sales in the manufactured luggage cases, these molds become unsuitable and need to be discarded. In addition, the manufacturer needs to invest another round of mold costs needed for a launching another product. The cycle above may lead to not only increased costs for the manufacturer but also waste in resources.

SUMMARY OF THE INVENTION

Therefore, it is a primary object of the present invention to solve issues of a conventional luggage case manufacturing method.

To achieve the above object, the present invention provides a case body structure of a luggage case. The case body structure of a luggage case includes a case top member, a case bottom member and a sidewall member. Each of the case top member and the case bottom member is a hard structure. The sidewall member includes a wall plate and a cover plate. The wall plate includes a connecting section, two installation sections respectively integrally extended from two opposite lateral sides of the connecting section and perpendicular to the connecting section, and an installation breach defined and formed by the two installation sections.

The cover plate corresponds to the installation breach, and is disposed on the two installation sections. The cover plate and the wall plate define a hollow cavity. Each of the case top member, the case bottom member and the sidewall member is an independent component. The case top member and the case bottom member are respectively disposed at two ends of the sidewall member to enclose the hollow cavity. The cover plate selectively opens relative to the wall plate to allow an object to be placed into or taken out of the hollow cavity.

In one embodiment, the width of the connecting section of the wall plate is greater than the width of each of the installation sections, and the width of the installation breach is smaller than or equal to the width of the connecting section and greater than the width of each of the installation sections.

In one embodiment, the wall plate includes a support element and a flexible outer layer clad on the support element. The flexible outer layer is assembled to the case top member and the case bottom member. Two ends of the support element are respectively abutted against the case top member and the case bottom member to cause the flexible outer layer to be tightened relative to the support element.

In one embodiment, each of the case top member and the case bottom member includes an assembly groove for abutting and connecting with the sidewall member.

In one embodiment, the flexible outer layer is selected from the group consisting of textile, nylon, leather and polyvinyl chloride (PVC).

In one embodiment, the wall plate is a formed integral made of a hard plastic material.

In one embodiment, the case body structure further includes at least two suture shutters. Each of the suture shutters is disposed at a seam of the case top member and the sidewall member or the case bottom member and the sidewall member, and includes a connecting portion being deep into the seam and a shutter portion integrally extended from the connecting portion and protruding out of the seam.

The present invention further provides a luggage case, which applies one of the case body structures of the foregoing embodiments. The luggage case further includes a pull handle and a pull handle positioning module. The pull handle is assembled to the case body structure. The pull handle positioning module includes a support sleeve disposed on the case top member and causing the pull handle to be inserted therein and to be able to perform a back-and-forth movement, and a limiting element disposed in the support sleeve and limiting or allowing the pull handle to perform the back-and-forth movement relative to the support sleeve.

In one embodiment, the case top member includes an installation opening in communication with the hollow cavity and allowing the support sleeve to be correspondingly disposed therein. The support sleeve is further located in the hollow cavity.

In one embodiment, the luggage case further includes a plurality of rollers disposed on the case bottom member. The case body member includes a plurality of assembly holes, which are in a quantity corresponding to the rollers and are respectively assembled with the rollers.

In one embodiment, the pull handle includes an outer tube assembled to the case body structure, and an inner tube inserted in the outer tube and capable of stretching and retracting relative to the outer tube.

In one embodiment, each of the plurality of rollers includes a roller frame, two roller plates assembled with the roller frame, and a mounting post connected to the roller frame and threaded through one of the plurality of assembly holes for mounting on the case bottom member.

In one embodiment, each of the mounting posts is formed with an assembly groove, the case bottom member includes a plurality of sockets respectively forming the assembly holes, and a plurality of quick disassemble components respectively corresponding to the plurality of sockets and assembled with the mounting post of one of the plurality of rollers. Each of the plurality of quick disassemble components includes a spring and a clamping plate connected to the spring, each of the clamping plates includes a through hole for providing one of the mounting posts to thread through, one end of each of the springs is pushed on one of the plurality of sockets, and another end of the springs is pushed against one of the clamping plates correspondingly disposed. Each of the clamping plates has a clamping state in which one of the springs pushes to cause an edge of the through hole to be placed in the assembly groove to prohibit one of the plurality of rollers from detaching from the case bottom member, and a release state in which an external force pushes to compress one of the springs to disengage the clamping plate from the assembly groove so that one of the rollers is capable of detaching from the case bottom member.

In one embodiment, each of the clamping plates comprises a connecting plate formed with the through hole and connected to one of the springs, and an operating rod connected to the connecting plate.

In one embodiment, each of the plurality of sockets includes a rail that provides one of the clamping plates to be disposed and the clamping plate is able to slide in the rail.

In one embodiment, each of the plurality of sockets includes a block plate disposed at an end of the rail adjacent to the sidewall member and providing for one end of one of the springs to abut against.

In one embodiment, each of the plurality of sockets includes a spring accommodating groove disposed at an end of the rail adjacent to the block plate and an operating rod accommodating groove disposed at an end of the rail not provided with the spring accommodating groove.

In one embodiment, the case bottom member comprises a plurality of covers disposed correspondingly to the plurality of sockets to shield one of the rails.

Through the above technical solution, the present invention provides following features as opposed to the prior art:

The Applicant of the application considers that the size, as well as the outer appearance and design, are determined by the size and pattern of the case body structure instead of the design of a top surface or a bottom surface of the case body structure. Therefore, in the present invention, the case body structure is formed by the case top member, the case bottom member and the sidewall member that are independent components. During development and manufacturing, only one-time molds need to be made for the case top member and the case bottom member and may serve as universal parts. Thus, when a new product is developed, only the mold for the sidewall member needs to be manufactured, hence reducing unnecessary waste and development and manufacturing costs as well as enhancing market competitiveness.

DETAILED DESCRIPTION OF THE PREFERRED EMBODIMENTS

Details and technical contents of the present invention are given with the accompanying drawings below.

Figure 1:
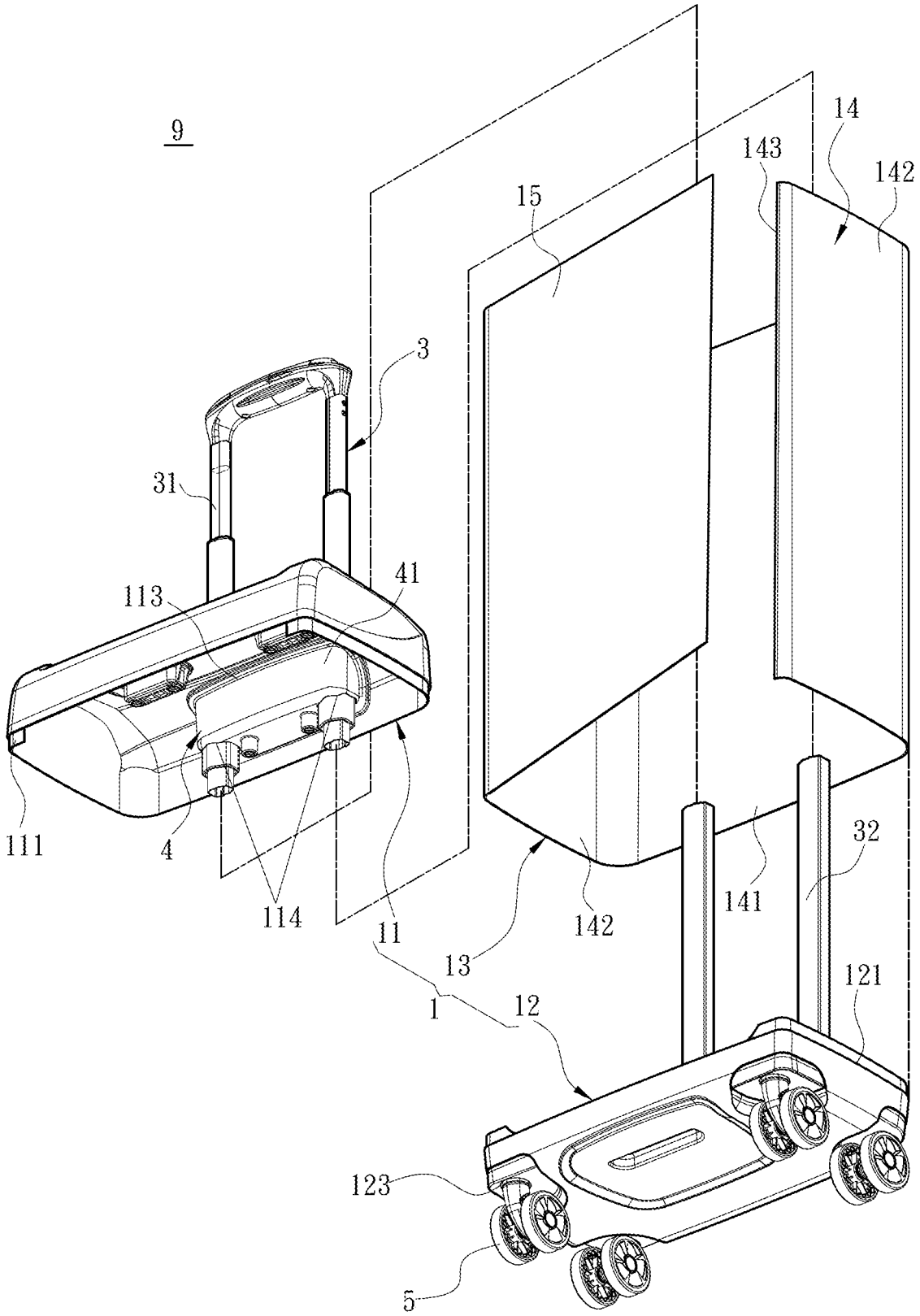
FIG. 1 is an exploded view of a structure according to an embodiment of the present invention.
Figure 2:
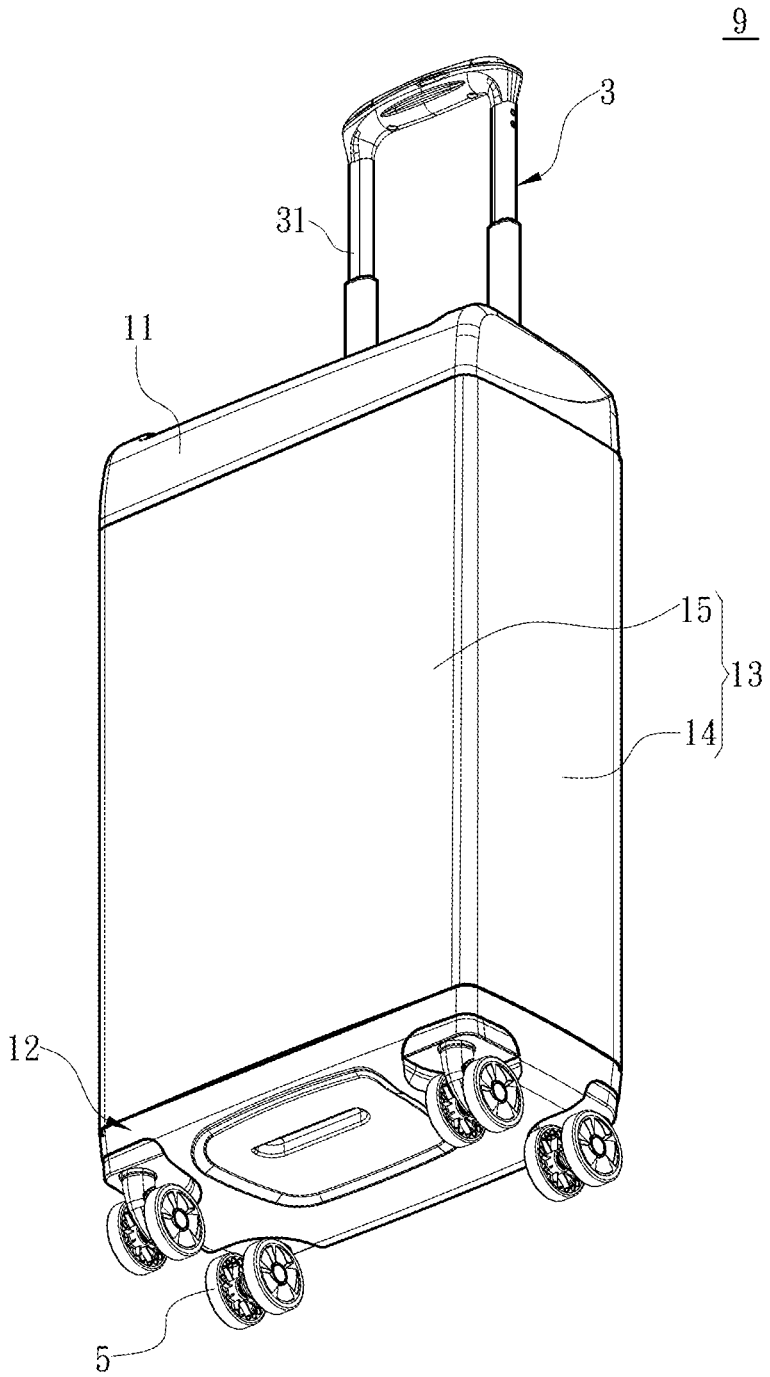
FIG. 2 is an appearance schematic diagram of a structure according to an embodiment of the present invention.
Figure 3:
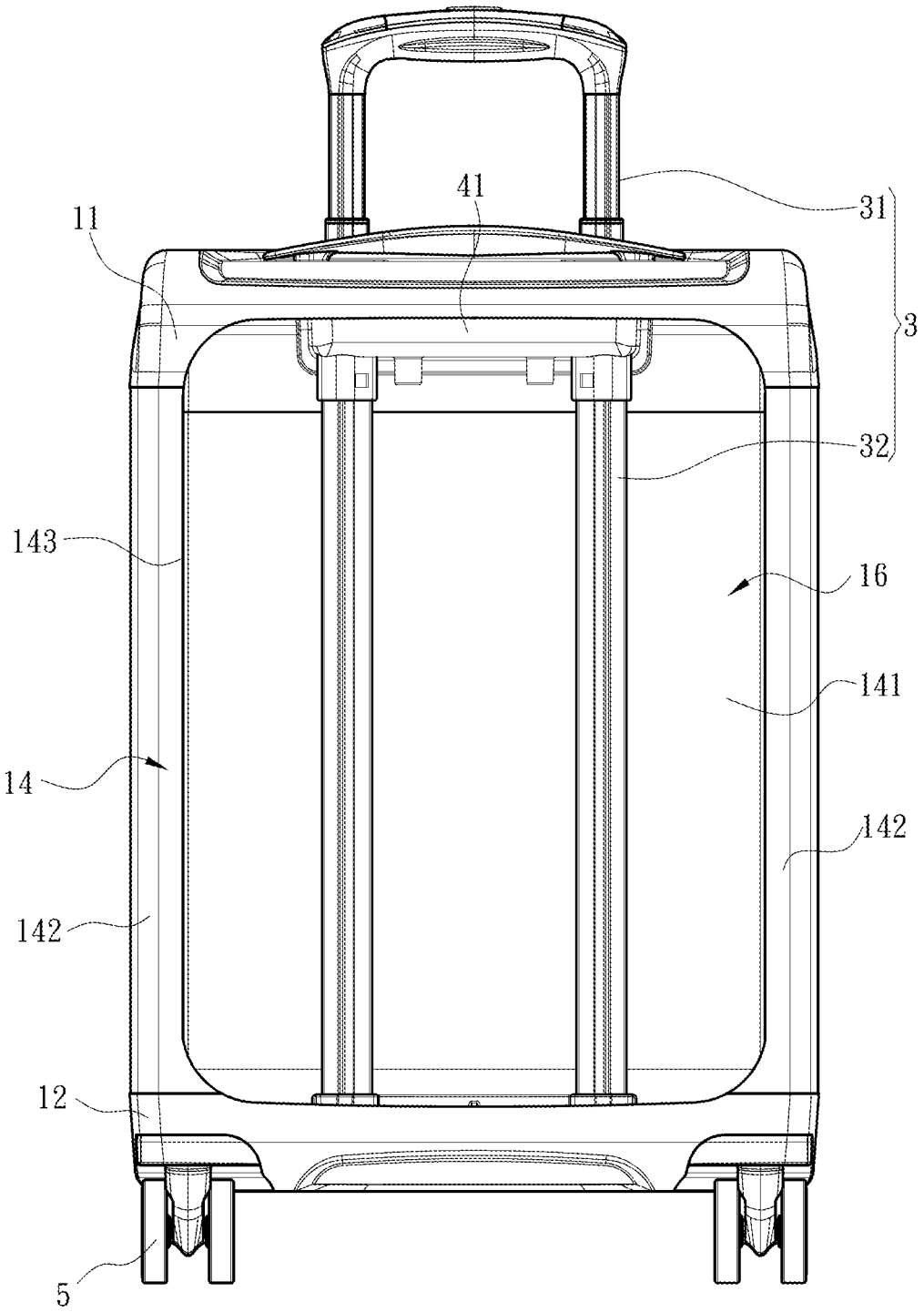
FIG. 3 is a front view of a luggage case not provided with a cover plate according to an embodiment of the present invention.

Referring to FIGS. 1, 2, and 3, the present invention provides a luggage case and a case body structure thereof. The case body structure 1 includes a case top member 11, a case bottom member 12 and a sidewall member 13. Each of the case top member 11, the case bottom member 12 and the sidewall member 13 is an independent component. That is, the case top member 11, the case bottom member 12 and the sidewall member 13 are individually manufactured, and are not a formed integral. Further, each of the case top member 11 and the case bottom member 12 is a hard structure, which may be made of a plastic material such as polypropylene (PP), polycarbonate (PC) or polyethylene terephthalate (PET). The case top member 11 or the case bottom member 12 may be a formed integral made by machinery processing. The case top member 11 and the case bottom member 12 may be corresponding structure designs based on actual requirements to bear an expect load weight, so as to prevent the case top member 11 or the case bottom member 12 from deformation during a weight bearing process.

Figure 4:
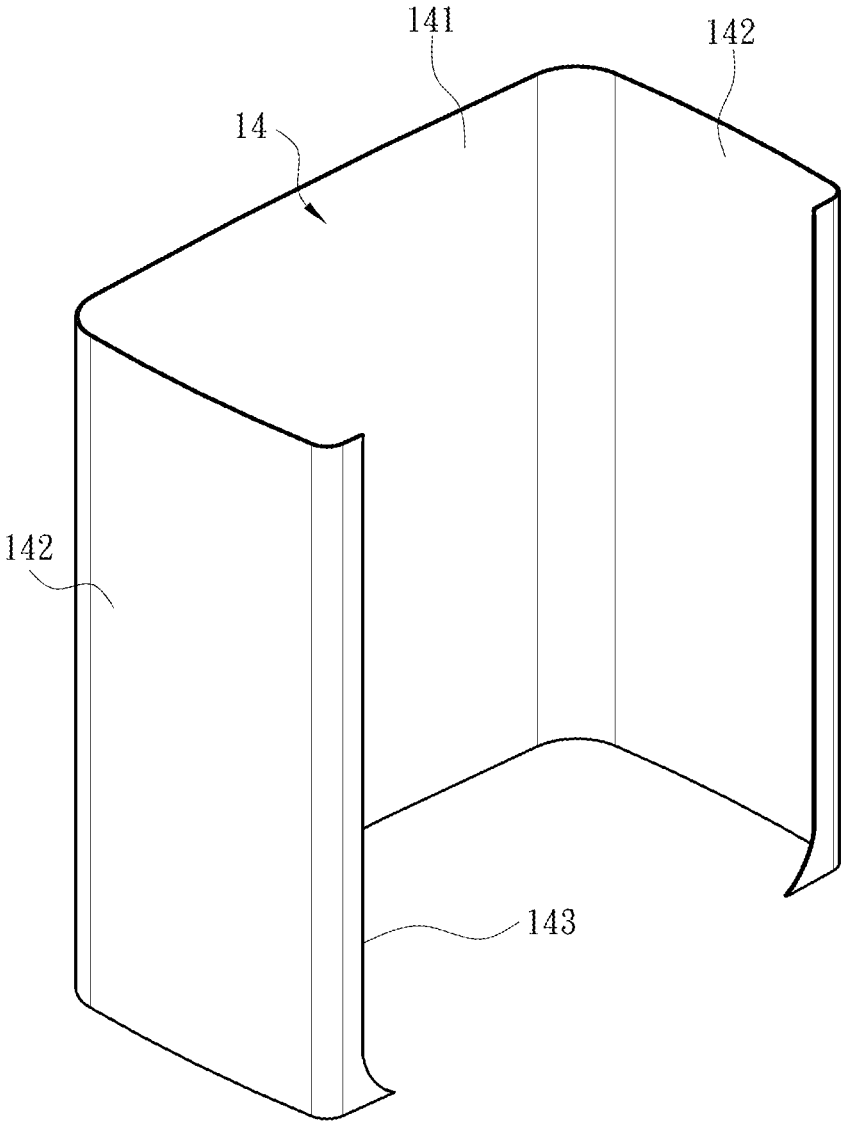
FIG. 4 is a schematic diagram of a wall plate according to an embodiment of the present invention.

The sidewall member 13 includes a wall plate 14 and a cover plate 15. The wall plate 14 in overall appears substantially U-shaped, as shown in FIG. 4. The wall plate 14 includes a connecting section 141, two installation sections 142 respectively integrally extended from two opposite lateral sides of the connecting section 141 and perpendicular to the connecting section 141, and an installation breach 143 defined and formed by the two installation sections 142. Further, the wall plate 14 may be designed with at least one recessed pattern or protruding block according to esthetic requirements. The cover plate 15 corresponds to the installation breach 143 and is disposed on the two installation sections 142, and the cover plate 15 and the wall plate 14 define a hollow cavity 16 when assembled. Two ends of the hollow cavity 16 are not shielded and appear as a through formed. That is, when not assembled to the case top member 11 and the case bottom member 12, the sidewall member 13 appears as a through form with two open ends. To assemble the case body structure 1, the case top member 11 and the case bottom member 12 are respectively disposed correspondingly to the two open ends of the sidewall member 13 to enclose the two ends of the sidewall member 13, thereby completing the case body structure 1 of the present invention. Further, the cover plate 15 is assembled to the wall plate 14 by a zipper (not shown), such that the cover plate 15 may selectively open or close relative to the wall plate 14. When the cover plate 15 opens relative to the wall plate 14, an object may be placed into or taken out of the hollow cavity 16.

Figure 7:
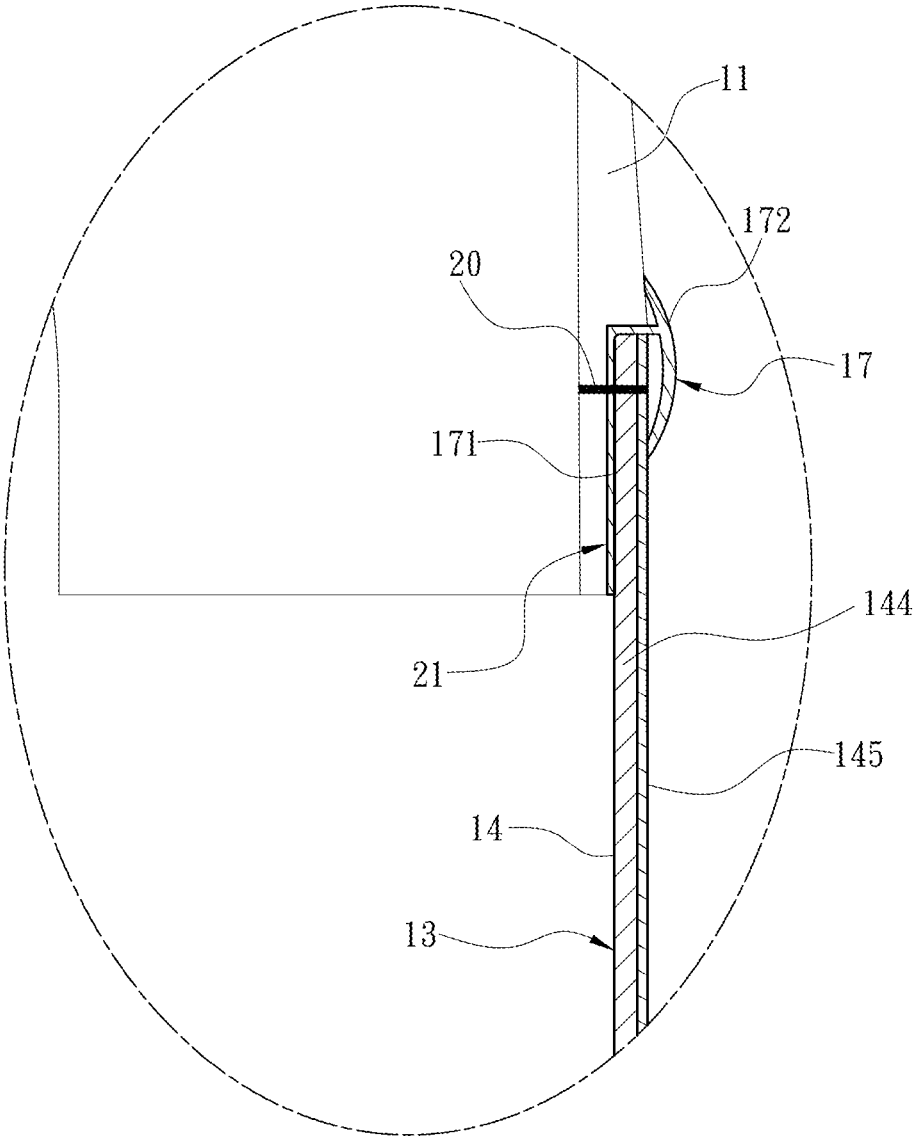
FIG. 7 is a partial schematic diagram of a case top member and a sidewall member according to a third embodiment of the present invention.

Referring to FIG. 4, in the present invention, the width of the connecting section 141 of the wall plate 14 is greater than the width of each of the installation sections 142, and the width of the installation breach 143 is smaller than or equal to the width of the connecting section 141 but greater than the width of each of the installation sections 142. For example but not limited to, the wall plate 14 and the cover plate 15 may be implemented by a hard plastic material. Please refer to FIG. 5 and FIG. 7, in one embodiment, the wall plate 14 includes a support element 144 and a flexible outer layer 145 clad on the support element 144. The flexible outer layer 145 has an appropriate flexibility to be appropriately stretched, and is selected from the group consisting of textile, nylon, leather and polyvinyl chloride (PVC). Further, the flexible outer layer 145 is assembled to the case top member 11 and the case bottom member 12, and a remaining length of the part of the flexible outer layer 145 after the flexible outer layer 145 is assembled to the case top member 11 and the case bottom member 12 is smaller than the length of the support element 144. When two ends of the support element 144 are respectively abutted against the case top member 11 and the case bottom member 12, the case top member 11 and the case bottom member 12 are spaced by a distance, owing to which the flexible outer layer 145 is caused be tightened relative to the support element 144. Further, when the flexible outer layer 145 is tightened, the case top member 11 and the case bottom member 12, under the effect of the flexible outer layer 145, are more stably pressed upon the support element 144, such that better assembly effects among the components of the case body structure 1 are achieved.

In the present invention, since the sidewall member 13 is not a formed integral with the case top member 11 or the case bottom member 12, a manufacturer or a consumer may select different patterns or materials for the sidewall member 13 according to designs or preferences. Further, with the present invention, a manufacturer is required to only replace the mold of the sidewall member 13 when launching a new product, hence innovating a conventional implementation of replacing an entire set of molds for a new product when a manufacturer launches the new product.

In one embodiment, respective ends of the case top member 11 and the case bottom member 12 predetermined to be assembled to the sidewall member 13 are provided with assembly grooves 111 and 121 for abutting and connecting with the sidewall member 13. The assembly grooves 111 and 121 may further surround the case top member 11 or the case bottom member 12. However, in an assembly process, the sidewall member 13 may be assembled to the case top member 11 and the case bottom member 12 by aligning with the assembly grooves 111 and 121. As such, the sidewall member 13 is substantially positioned to effectively support the case top member 11 and the case bottom member 12.

Figure 5:
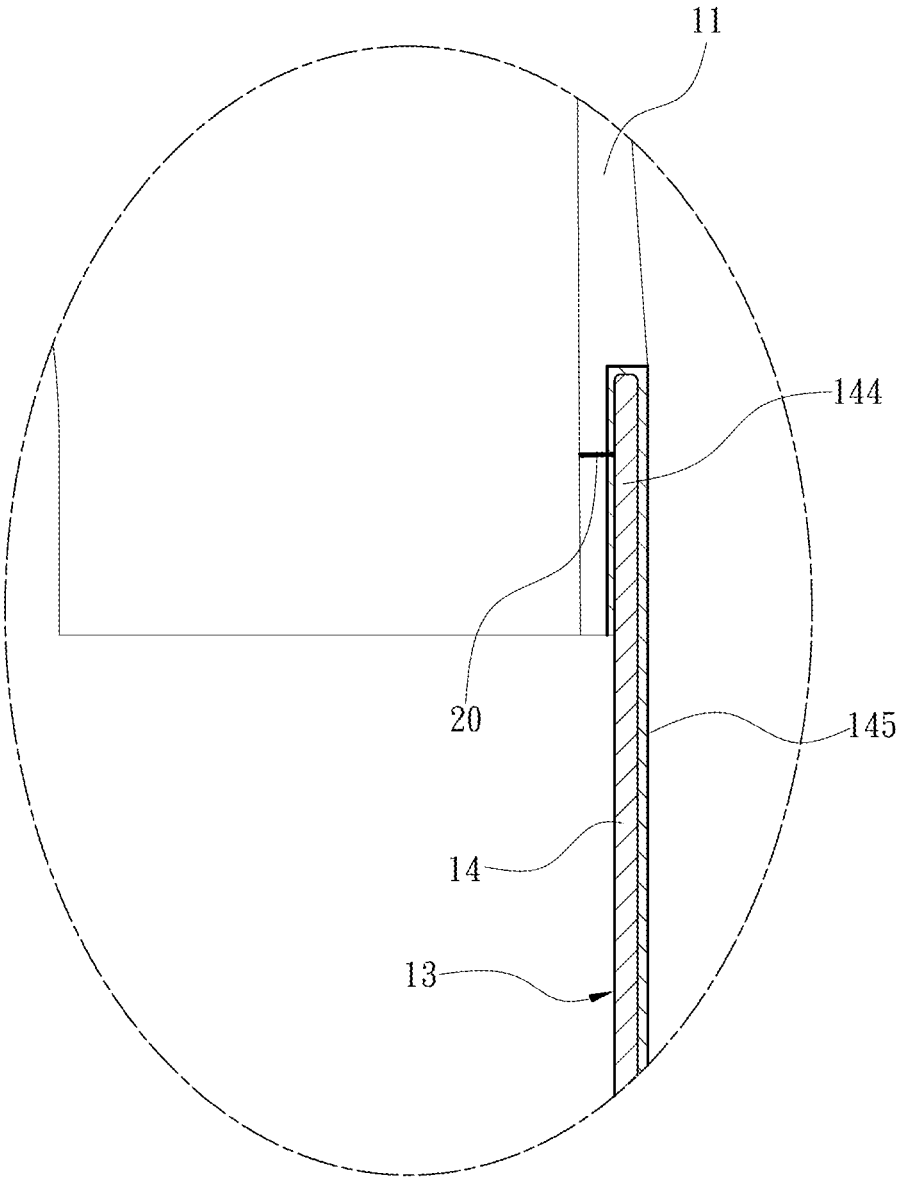
FIG. 5 is a partial schematic diagram of a case top member and a sidewall member according to a first embodiment of the present invention.

Referring to FIG. 5, in the present invention, the fastening between the case top member 11 or the case bottom member 12 and the sidewall member 13 may be achieved through a stitching method. As known from foregoing embodiments, only after the flexible outer layer 145 is assembled to the case top member 11 and the case bottom member 12, the sidewall member 13 is then assembled to the support element 144. The flexible outer layer 145 may be assembled to the case top member 11 and the case bottom member 12 through stitching (as shown by the stitching position 20 in FIG. 5), and the assembly of the support element 144 may then be performed after the flexible outer layer 145 is completely assembled.

Figure 6:
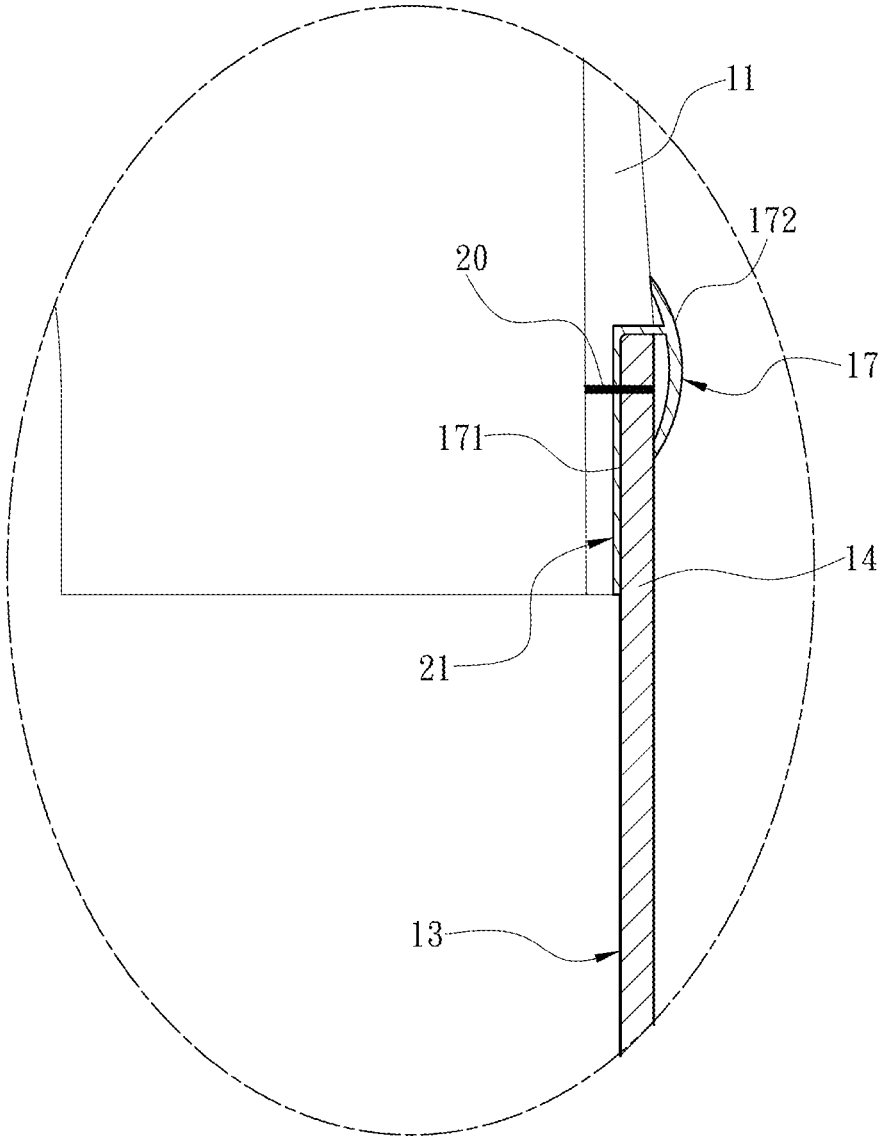
FIG. 6 is a partial schematic diagram of a case top member and a sidewall member according to a second embodiment of the present invention.

Referring to FIG. 6, in another embodiment, the wall plate 14 may be implemented by a hard structure, and after the case top member 11 or the case bottom member 12 is assembled to the sidewall member 13, an overlapping region of the two components assembled to each other may be stitched to produce a securing effect. To more substantially implement stitching, the thickness of the sidewall member 13 of the present invention is selected to meet an appropriate support strength and to be within a range that can be stitched. Further, the stitching position 20 of the case top member 11 or the case bottom member 12 may also be correspondingly designed to facilitate the implementation of stitching. Further, to optimize the esthetic appearance after the stitching process, the case body structure 1 further includes at least two suture shutters 17. Each of the suture shutters 17 is disposed at a seam 21 of the case top member 11 and the sidewall member 13 or the case bottom member 12 and the sidewall member 13, and includes a connecting portion 171 being deep into the seam 21 and a shutter portion 172 integrally extended from the connecting portion 171 and protruding out of the seam 21. During the implementation of the stitching process, while the case top member 11 (or the case bottom member 12) is aligned with the sidewall member 13, the connecting portion 171 of one of the suture shutters 17 is correspondingly placed at the seam 21 between the case top member 11 (or the case bottom member 12) and the sidewall member 13, such that the shutter portion 172 protrudes from the seam 21 and is revealed at an outer side of the sidewall member 13. The case top member 11 (or the case bottom member 12), the connecting portion 171 of one of the suture shutters 17 and the sidewall member 13 are stitched to secure the three through stitching. Then, the shutter portion 172 is used to cover the stitching position 20 to polish the overall appearance of the case body structure 1. Further, in the present invention, each of the suture shutters 17 is a formed integral made from a soft plastic material. Further, the technical solution of implementing the two suture shutters 17 may be applied to the embodiment of the wall plate 14 including the support element 144 and the flexible outer layer 145, with associated details shown in FIG. 7.

Figure 8:
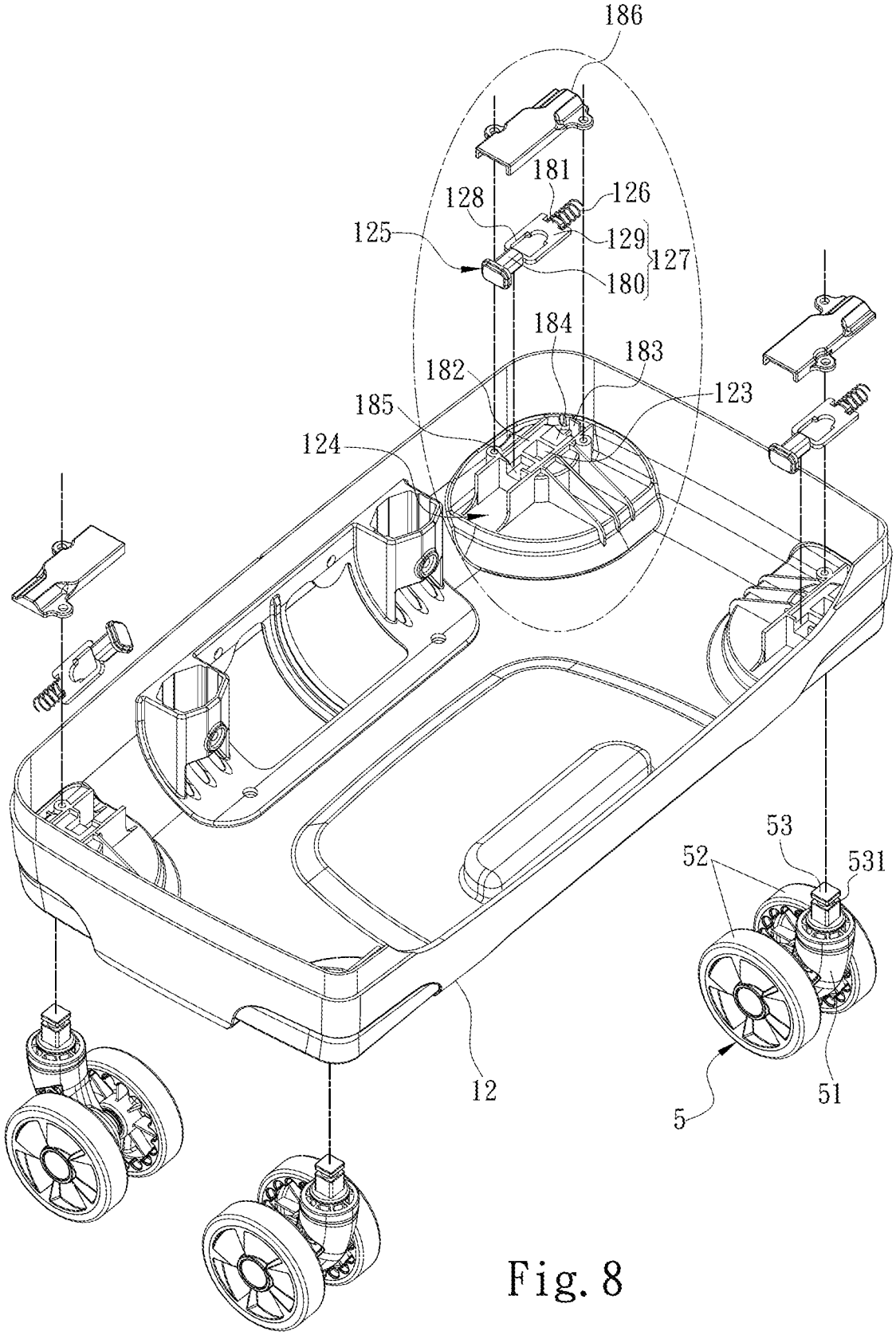
FIG. 8 is an exploded view of a case bottom member and rollers according to another embodiment of the present invention.
Figure 9:
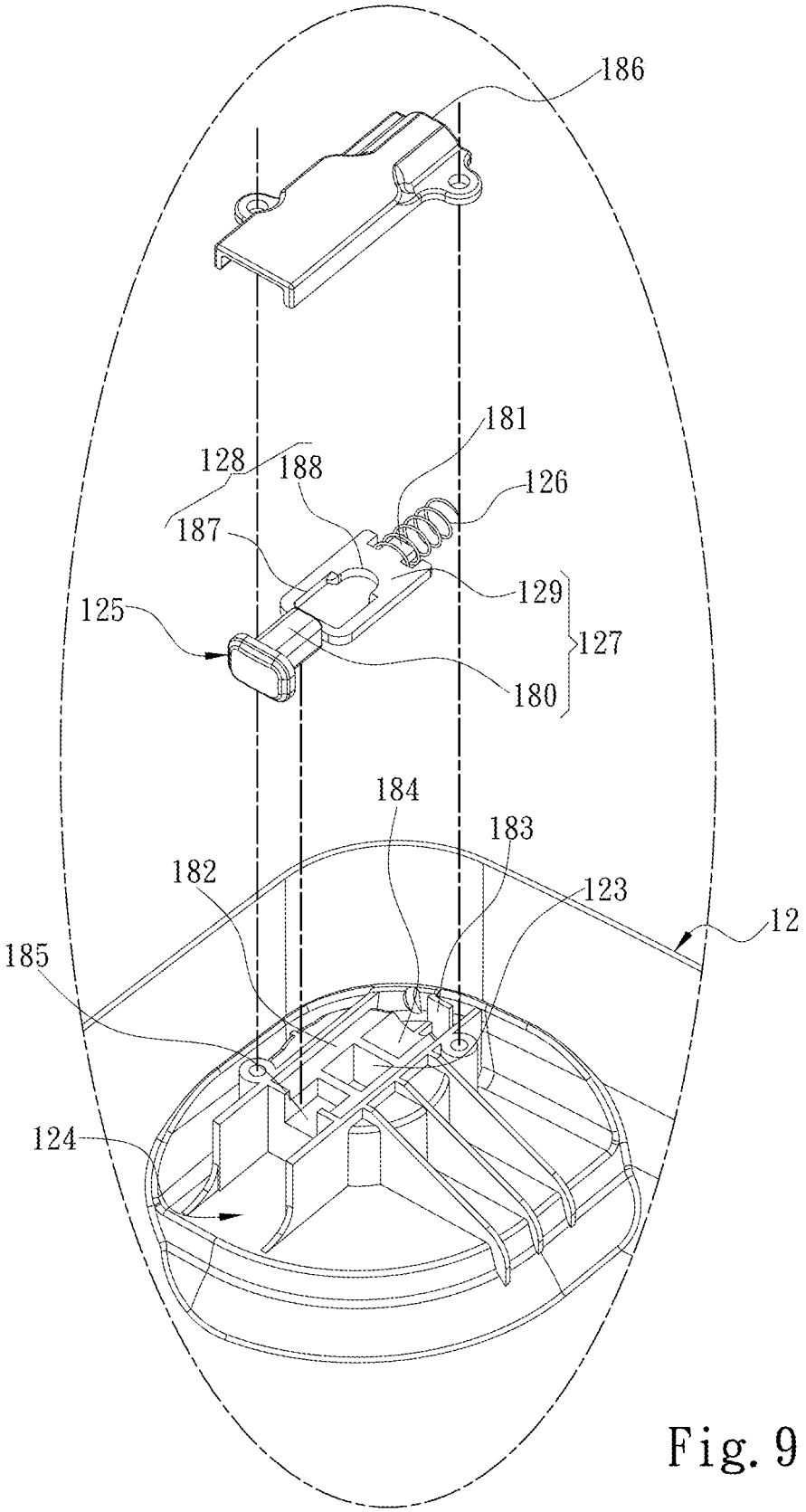
FIG. 9 is a partially exploded view of the case bottom member according to another embodiment of the present invention.
Figure 10:
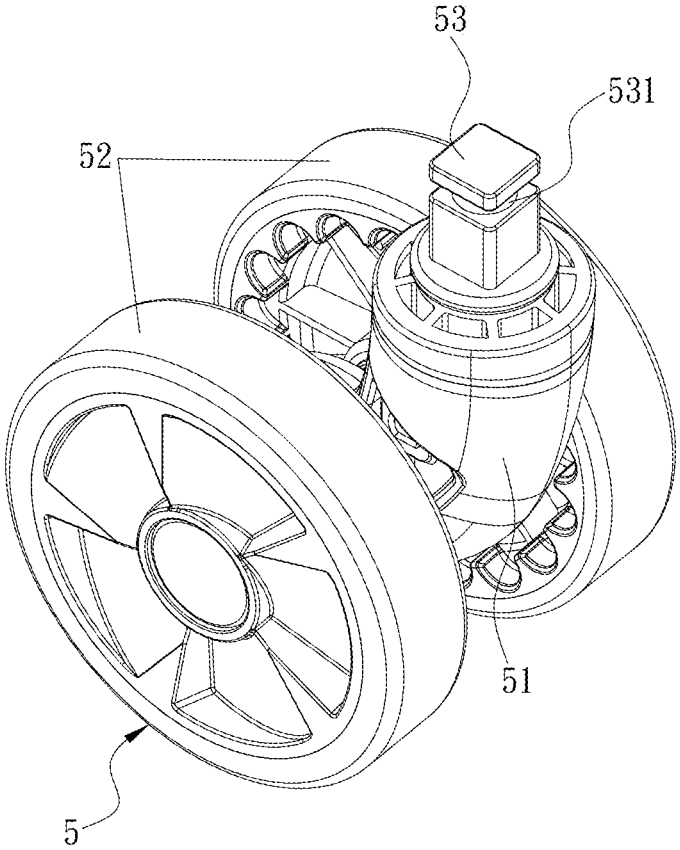
FIG. 10 is a schematic view of the structure of the roller according to another embodiment of the present invention.

Again referring to FIGS. 1, 2, and 3, in addition to the foregoing case body structure 1, the present invention further discloses a luggage case 9. The luggage case 9 applies the case body structure 1 disclosed in the above-mentioned embodiments, and further includes a pull handle 3 and a pull handle positioning module 4. The pull handle 3 is assembled with the case body structure 1. The pull handle positioning module 4 includes a support sleeve 41 disposed on the case top member 11, and a limiting element (not shown) disposed in the support sleeve 41. The support sleeve 41 may be installed at an outer edge of the case top member 11 or inside the hollow cavity 16. Further, the case top member 11 may include an installation opening 113 in communication with the hollow cavity 16 and allowing the support sleeve 41 to be correspondingly disposed at an inner edge of the case top member 11 and an opening 114 provided for the pull handle 3 to pass through. Further, the support sleeve 41 allows the pull handle 3 to be installed therein, such that the pull handle 3 is capable of performing a back-and-forth movement relative to the support sleeve 41, i.e., the pull handle 3 is capable of performing drawing and pulling operations relative to the support sleeve 41. Further, apart from being disposed in the support sleeve 41, the limiting element further allows the pull handle 3 to be inserted and disposed therein, or limits or allows the pull handle 3 to perform the back-and-forth movement relative to the support sleeve 41. In addition, the luggage case 9 further includes a plurality of rollers 5, which are disposed at an outer edge of the case bottom member 12 and distributed at four corners of the case bottom member 12. Further, the case bottom member 12 includes a plurality of assembly holes 123 respectively corresponding to the plurality of rollers 5 and respectively assembled to the rollers 5. Referring to FIGS. 8, 9, and 10 together, each of the plurality of rollers 5 comprises a roller frame 51, two roller plates 52 assembled with the roller frame 51, and a mounting post 53 connected to the roller frame 51 and threaded through one of the plurality of assembly holes 123 for mounting on the case bottom member 12. Further, each of the mounting posts 53 is formed with an assembly groove 531. The case bottom member 12 includes a plurality of sockets 124 respectively forming the plurality of assembly holes 123 and a plurality of quick disassemble components 125 respectively corresponding to the plurality of sockets 124 and assembled with the mounting post 53 of one of the plurality of rollers 5. Further, each of the plurality of quick disassemble components 125 includes a spring 126 and a clamping plate 127 connected to the spring 126. The extending direction of each of the clamping plates 127 is perpendicular to the extending direction of each of the plurality of assembly holes 123. Each of the clamping plates 127 includes a through hole 128 for providing one of the mounting posts 53 to thread through. That is, the through hole 128 of each of the clamping plates 127 is communicated with the assembly hole 123. On the other hand, one end of each of the springs 126 is pushed on one of the plurality of sockets 124, and another end of the springs 126 is pushed against one of the clamping plates 127 correspondingly disposed. Each of the springs 126 normally pushes against one of the clamping plates 127, such that the clamping plate 127 is located at an edge of the through hole 128 to interfere with the assembly hole 123. Therefore, each of the clamping plates 127 has a clamping state in which one of the springs 126 pushes to cause the edge of the through hole 128 to be placed in the assembly groove 531 to prohibit one of the plurality of rollers 5 from detaching from the case bottom member 12, and a release state in which an external force pushes to compress one of the springs 126 to disengage the clamping plate 127 from the assembly groove 531 so that one of the plurality of rollers 5 is capable of detaching from the case bottom member 12. Specifically, when one of the plurality of rollers 5 is inserted into one of the assembly holes 123, one of the clamping plates 127 to be assembled is first brought into the release state, so that the mounting post 53 of the roller 5 is able to pass through one of the assembly holes 123. Thus, when the roller 5 is assembled, the assembly groove 531 of the mounting post 53 on the roller 5 will be horizontally disposed with the clamping plate 127. When the clamping plate 127 is switched from the released state to the clamping state, the clamping plate 127 is located at the edge of the through hole 128 and enters the assembly groove 531, so that the roller 5 cannot be separated from the case bottom member 12. Moreover, each of the clamping plates 127 of the present invention prohibits the separation of one of the plurality of rollers 5 from the case bottom member 12, but does not restrict the rotation of the roller 5 relative to the case bottom member 12. It is because that each of the clamping plates 127 is connected to the mounting post 53 of one of the plurality of rollers 5 in a clamping manner, and each of the clamping plates 127 slides along the assembly groove 531 when one of the plurality of rollers 5 rotates. Furthermore, when one of the plurality of rollers 5 is damaged and needed to be replaced, the roller 5 can be separated from the case bottom member 12 simply by switching the corresponding holding pieces 127 into the released state again. In addition to the foregoing, the present invention allows the plurality of rollers 5 to be quickly assembled while manufacturing the luggage case 9. Besides, in an embodiment, the through hole 128 of each of the clamping pieces 127 further includes a square hole portion 187 and a semicircular hole portion 188 connected to the square hole portion 187. The shape of the semicircular hole portion 188 is substantially corresponding to the shape of the mounting post 53 at the assembly groove 531. When each of the clamping plates 127 is in the clamping state, the semicircular hole portion 188 of the through hole 128 is located in one of the assembly grooves 531.

Further referring to FIGS. 8, 9, and 10, in one embodiment, each of the clamping plates 127 comprises a connecting plate 129 formed with the through hole 128 and connected to one of the springs 126, and an operating rod 180 connected to the connecting plate 129. Further, the connecting plate 129 is provided with at least one protruding column 181 on a side connected to one of the springs 126. The protruding column 181 provides one of the springs 126 disposed thereon. Referring to FIG. 9, in one embodiment, each of the plurality of sockets 124 includes a rail 182 that provides one of the clamping plates 127 to be disposed and the clamping plate 127 is able to slide in the rail 182. The rail 182 is formed by a recess on the plurality of sockets 124. Further, each of the plurality of sockets 124 includes a block plate 183 disposed at an end of the rail 182 adjacent to the sidewall member 13 and providing for one end of one of the springs 126 to abut against. In one embodiment, each of the plurality of sockets 124 includes a spring accommodating groove 184 disposed at an end of the rail 182 adjacent to the block plate 183 and an operating rod accommodating groove 185 disposed at an end of the rail 182 not provided with the spring accommodating groove 184, wherein the spring accommodating groove 184 provides the spring 126 to be placed therein, and the operating rod accommodating groove 185 provides the operating rod 180 to be placed therein, and the size of the operating rod accommodating groove 185 is required to conform to at least the displacement of the operating rod 180. Referring to FIGS. 8 and 9, in one embodiment, the case bottom member 12 further includes a plurality of covers 186 respectively corresponding to the plurality of sockets 124 for shielding one of the rails 182. The assembly strength between the plurality of covers 186 and the plurality of sockets 124 may be increased through a plurality of assembly components (not shown). Please refer to FIGS. 1, 2, and 3, in one embodiment, the pull handle 3 further includes an outer tube 31 assembled to the case body structure 1, and an inner tube 32 inserted in the outer tube 31 and capable of stretching and retracting relative to the outer tube 31. In other words, when the pull handle 3 is pulled and drawn by a consumer, the inner tube 32 slides relative to the outer tube 31 to protrude out of the outer tube 31 for the consumer to push or pull. Then, after releasing the limitation of the limiting element on the pull handle 3, the consumer may apply a force to push the inner tube 32 towards the outer tube 31 to retract the inner tube 32 back into the outer tube 31.

What is claimed is:

1. A luggage case, comprising:

a case body structure, comprising a case top member, a case bottom member and a sidewall member, the case top member and the case bottom member respectively being a hard structure, the case top member including two openings, the case bottom member including a plurality of assembly holes, the sidewall member comprising a U-shaped wall plate and a cover plate, wherein the wall plate comprises a connecting section, two installation sections respectively integrally extended from two opposite lateral sides of the connecting section and perpendicular to the connecting section, and an installation breach defined and formed by the two installation sections, and the cover plate corresponds to the installation breach and is disposed on the two installation sections, the cover plate and the wall plate define a hollow cavity, each of the case top member, the case bottom member and the sidewall member being an independent component, the case top member and the case bottom member respectively having an assembly groove for abutting and connecting with the sidewall member, and respectively disposed at two ends of the sidewall member to enclose the hollow cavity, and the cover plate selectively opening relative to the wall plate to allow an object to be placed into or taken out of the hollow cavity;

a pull handle assembled with the case body structure and threaded through the two openings;

a pull handle positioning module comprising a support sleeve disposed on the case top member and allowing the pull handle to be threaded through the two openings and to perform a back-and-forth movement; and a plurality of rollers, each of the plurality of rollers respectively disposed on one of the plurality of assembly holes of the case bottom member, wherein each of the plurality of rollers comprises a roller frame, two roller plates assembled with the roller frame, and a mounting post connected to the roller frame and threaded through one of the plurality of assembly holes for mounting on the case bottom member; and wherein each of the mounting posts is formed with an assembly groove, the case bottom member comprises a plurality of sockets respectively forming the plurality of assembly holes, and a plurality of quick disassemble components respectively corresponding to the plurality of sockets and assembled with the mounting post of one of the plurality of rollers, each of the plurality of quick disassemble components includes a spring and a clamping plate connected to the spring, each of the clamping plates comprises a through hole for providing one of the mounting posts to thread through, one end of each of the springs is pushed on one of the plurality of sockets, and another end of the springs is pushed against one of the clamping plates correspondingly disposed, each of the clamping plates has a clamping state in which one of the springs pushes to cause an edge of the through hole to be placed in the assembly groove to prohibit one of the plurality of rollers from detaching from the case bottom member, and a release state in which an external force pushes to compress one of the springs to disengage the clamping plate from the assembly groove so that one of the plurality of rollers is capable of detaching from the case bottom member.

2. The luggage case of claim 1, wherein the case top member comprises an installation opening in communication with the hollow cavity and allowing the support sleeve to be correspondingly disposed, and the support sleeve is further located in the hollow cavity.

3. The luggage case of claim 1, wherein the pull handle comprises an outer tube assembled to the case body structure, and an inner tube inserted in the outer tube and capable of stretching and retracting relative to the outer tube.

4. The luggage case of claim 1, wherein a width of the connecting section of the wall plate is greater than a width of each of the installation sections, and a width of the installation breach is smaller than or equal to the width of the connecting section and greater than the width of each of the installation sections.

5. The luggage case of claim 4, wherein the wall plate comprises a support element and a flexible outer layer clad on the support element, the flexible outer layer is assembled to the case top member and the case bottom member, and two ends of the support element are respectively abutted against the case top member and the case bottom member to cause the flexible outer layer to be tightened relative to the support element.

6. The luggage case of claim 5, wherein the flexible outer layer is selected from the group consisting of textile, nylon, leather and polyvinyl chloride (PVC).

7. The luggage case of claim 1, wherein the wall plate is integrally formed by a hard plastic material.

8. The luggage case of claim 1, wherein the case body structure comprises at least two suture shutters, each of the suture shutters is disposed at a seam of the case top member and the sidewall member or the case bottom member and the sidewall member, and each of the suture shutters comprises a connecting portion being deep into the seam and a shutter portion integrally extended from the connecting portion and protruding out of the seam.

9. The luggage case of claim 1, wherein each of the clamping plates comprises a connecting plate formed with the through hole and connected to one of the springs, and an operating rod connected to the connecting plate.

10. The luggage case of claim 9, wherein each of the plurality of sockets comprises a rail that providing one of the clamping plates to be disposed and the clamping plate is able to slide in the rail.

11. The luggage case of claim 10, wherein each of the plurality of sockets comprises a block plate disposed at an end of the rail adjacent to the sidewall member and providing for one end of one of the springs to abut against.

12. The luggage case of claim 11, wherein each of the plurality of sockets comprises a spring accommodating groove disposed at an end of the rail adjacent to the block plate and an operating rod accommodating groove disposed at an end of the rail not provided with the spring accommodating groove.

13. The luggage case of claim 12, wherein the case bottom member comprises a plurality of covers disposed correspondingly to the plurality of sockets to shield one of the rails.

* * * * *